United States Patent [19]

Sebastien

[11] 4,405,410

[45] Sep. 20, 1983

[54] MASKING OF ELONGATE THREE DIMENSIONAL OBJECTS FOR THE EXPOSURE OF PRESELECTED AREAS FOR SURFACE TREATMENT

[75] Inventor: Leslie Sebastien, Montreal, Canada

[73] Assignee: Northern Telecom Limited, Montreal, Canada

[21] Appl. No.: 339,394

[22] Filed: Jan. 15, 1982

[51] Int. Cl.[3] ..... C25D 5/02; C25D 17/04

[52] U.S. Cl. ..... 204/15; 204/224 R; 204/297 W

[58] Field of Search ..... 204/15, 224 R, 279, 204/297 W

[56] References Cited

U.S. PATENT DOCUMENTS

| | | | |
|---|---|---|---|
| 2,475,434 | 7/1949 | Moss | 204/297 W |
| 2,721,839 | 10/1955 | Taylor | 204/297 W |
| 3,254,004 | 5/1966 | Jackson | 204/15 |
| 3,972,785 | 8/1976 | Palisin | 204/297 W |

*Primary Examiner*—John F. Niebling
*Attorney, Agent, or Firm*—Sidney T. Jelly

[57] ABSTRACT

Surface treatment, for example precious metal plating, on preselected areas of elongate three dimensional objects is obtained by applying a masking member, at least to the ends of the objects. The masking member has a shape such that when the objects are inserted into bores in the member, predetermined areas are exposed where the bores open out through the member. A typical shape is a dumb-bell shape, with the central web portion of the same dimension as the bores. Thus the bores break through. The objects, for example terminal pins, are mounted on a support strip in spaced array and a plurality of masking members attached prior to passing through treatment tanks, for example plating tanks. The masking members are then removed.

6 Claims, 11 Drawing Figures

MASKING OF ELONGATE THREE DIMENSIONAL OBJECTS FOR THE EXPOSURE OF PRESELECTED AREAS FOR SURFACE TREATMENT

This invention relates to the masking of three elongate dimensional objects, and is particularly concerned with masking whereby precious metal plating will occur only on preselected areas.

Precious metal plating, for example gold plating, is applied to contact members of electrical and electronic systems, to provide good electrical contact conditions, i.e. low electrical contact resistance, minimum errosion and minimum corrosion. Taking as an example, terminal pins, which may be round or rectangular in cross-section, were previously plated over the whole length, and circumference, because it was quick and easy and relatively cheap. With the rapid increase in cost of precious metals, the cost of plating has increased substantially, becomming a significant part of the overall cost of the article.

Contact with a terminal pin normally occurs only at a localized area, or at localized areas, and plating is only required at these areas. Various ways now exist for restricting the plated areas. Two main methods can be used; either plating the whole member and then removing the plating from the areas where plating is not required, or attempting to mask the areas on which plating is not required. In the first method, there is the cost of recovering the precious metal from the stripping bath. In the second method, effective masking is difficult to achieve.

The present invention provides a means for masking terminal pins and similar elongate three dimensional objects, by attaching masking members, leaving local areas uncovered. The objects plus applied masks are then processed through a plating line, following which the masks are removed.

In the present invention, a masking member has a plurality of holes or bores into which objects such as terminal pins are inserted. The masking member has a reduced dimension for a part of its height, such that the holes or bores are opened laterally. Thus when objects are inserted into the bores of the masking member, certain areas are exposed at the positions where the bores open out. Plating will take place on these areas, but the remaining areas masked by the masking members will not be plated.

The invention will be readily understood by the following description, in conjunction with the accompanying drawings, in which.

Figure 1:
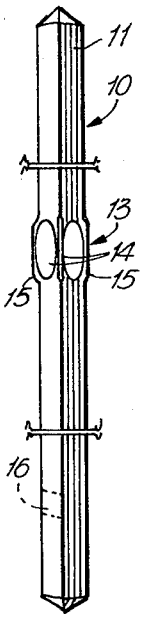
FIG. 1 is a perspective view of one form of terminal pin, showing a contact area.
Figure 4:
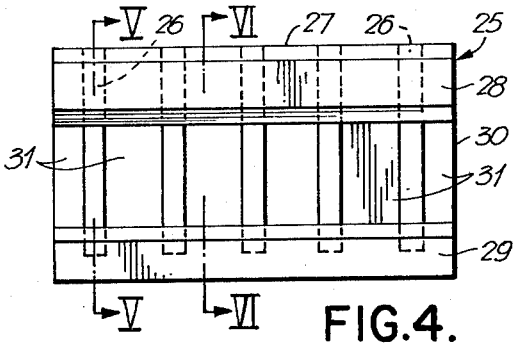
FIG. 4 is a side view of a masking member for terminal pins as in FIGS. 2 and 3.

A terminal pin as illustrated at 10 in FIG. 1, is of rectangular cross-section, for example square, and is inserted into a printed circuit board or other member. The upper end 11 projects for attachment of a conductor, as by wire wrapping or soldering, and the lower end 12 is inserted into a female contact member. The cross-section of the pin is usually slightly smaller than the hole or bore into which it fits in the circuit board or other member, but the pin is "coined" at an intermediate position 13, indentations 14 being formd, with the production of protrusions 15. The protrusions 15 provide a tight fit in the board or other member.

Contact between the lower end of the pin and the female contact member normally only occurs over a localized area, or areas. This area is indicated on one surface of the pin 10 at 16. A similar area usually occurs on the opposite side of the pins. Thus, for economy, only the area, or areas, 16 need be plated. Generally an area slightly larger than the contact area is plated to allow for variations in contact position due to manufacturing tolerances, and similar reasons.

Figure 2:
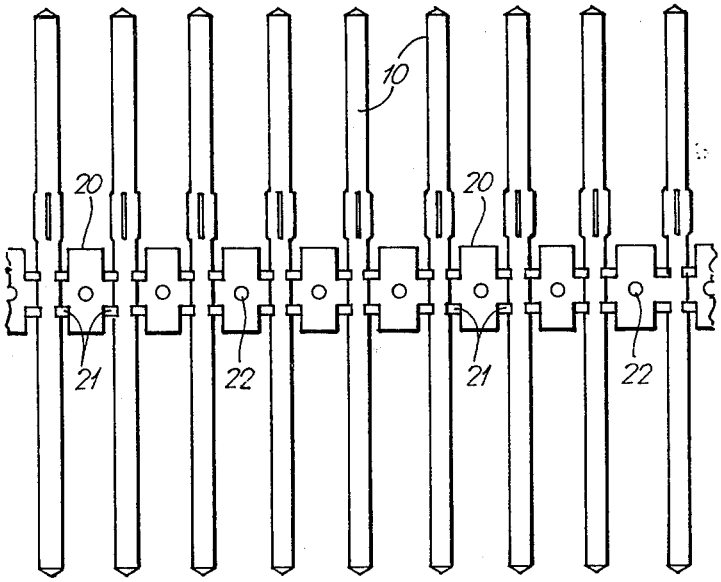
FIG. 2 is a side view of terminal pins, as in FIG. 1, mounted in a bandolier.
Figure 3:
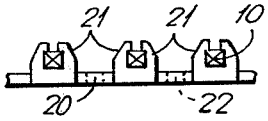
FIG. 3 is a bottom view on the arrangement illustrated in FIG. 2, showing three pins.
Figure 7:
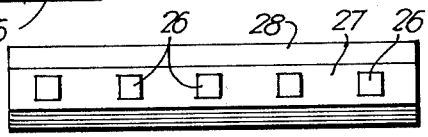
FIG. 7 is a top view of the member of FIGS. 4, 5 and 6.

For convenience in handling, such as for plating and/or automatic insertion, the terminal pins are mounted in a bandolier, indicated at 20 in FIGS. 2 and 3. The bandolier is made from a strip of metal, for example brass, with portions 21 bent up and over to hold the pins in place. The bandolier is also perforated, as shown at 22, for controlled feeding. The bandolier, and pins, is usually supplied in rolls.

Figure 5:
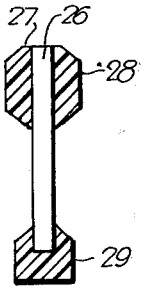
FIGS. 5 and 6 are cross-sections on the lines V—V and VI—VI respectively, of FIG. 4.
Figure 6:
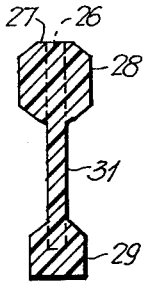

FIGS. 4, 5, 6 and 7 illustrate one form of masking member 25. In the example each masking member masks five terminal pins. The member 25 is of a flat, plate-like structure and has a somewhat dumb-bell cross-section, as seen in FIGS. 5 and 6. Five square bores 26 extend down from a top edge 27. The top and bottom portions 28 and 29 are thickened, while the waist portion 30 is of a thickness equal to the dimension of the bores 26. Thus the bores "break through" the sides of the waist portion 30. The result is that each member 25 has the thicker top and bottom portions 28 and 29 connected by sections 31, rather like a comb, the top and bottom portions 28 and 29 and sections 31 defining apertures 32. The end sections 31 are half the width of sections between bores 26.

Figure 8:
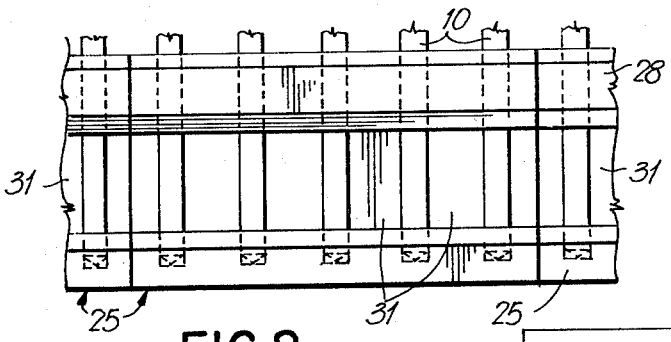
FIG. 8 is a side view of terminal pins and bandolier, as in FIG. 2, with masking members as in FIGS. 4 to 7 applied.

FIG. 8 illustrates masking members 25 applid to pins 10 on a bandolier 20. As the end sections 31 are only half the width of the sections between bores 26, members abut at their ends. This is not essential as some clearance can be provided between members 25. When the pins are in the members 25, an area on opposite sides of the cover ends is exposed through the apertures 32. The length, and position, of the waist portion 30 of members 25 defines the length of pin surface exposed and its position on the pin. In the example an area on opposite sides of a pin is exposed. If only one side is to be exposed then the waist portion would only be recessed on one side, the bores 26 breaking through only on that side to form an aperture on that side only.

Figure 9:
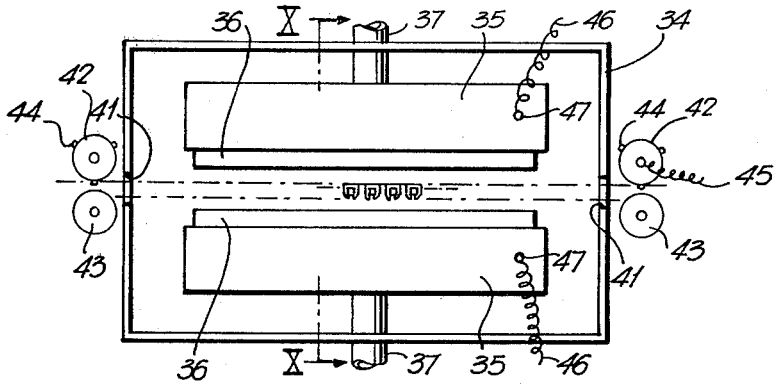
FIG. 9 is a top plan view of one form of plating tank, with lid removed.
Figure 10:
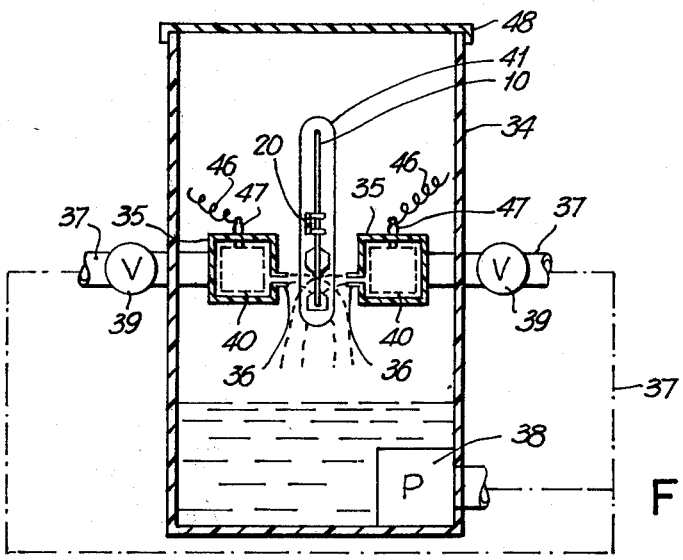
FIG. 10 is a cross-section on the line X—X of FIG. 9.

FIGS. 9 and 10 illustrate one form of plating apparatus. It comprises a tank 34, through which passes the bandolier 20 and pins 10. On either side of the path of the bandolier and pins is an elongate manifold 35, each with a nozzle 36. The nozzles can each be a continuous slot, or be in sections. Plating solution is fed to the manifolds 35 by pipes 37 from a pump 38 mounted in the bottom of the tank 35. Control valves 39 can be provided. A perforated metal anode 40, for example of gold for gold plating, is positioned in each manifold. The bandolier and pins enter and exit the tank through slots 41 in the ends of the tank. Rollers, as indicated at 42 and 43, drive the bandolier through the tank and vertically position the bandolier, by projections 44 on rollers 42; and also provide an electrical contact to the bandolier via a conductor 45. Conductor 46 is shown connected to a terminal 47 for each anode 40.

The plating solution exists from the nozzles 36 towards the pins 10, contacting the exposed areas of the pins in the masking members. The solution falls to the tank bottom where it is recirculated. If only one side of a pin is being plated then only one manifold and nozzle need be provided. The tank is provided with a lid 48 to prevent emission of spray from the tank top. In an alternative arrangement, the lower parts of the pins, with masks, may be immersed in a plating solution.

Figure 11:
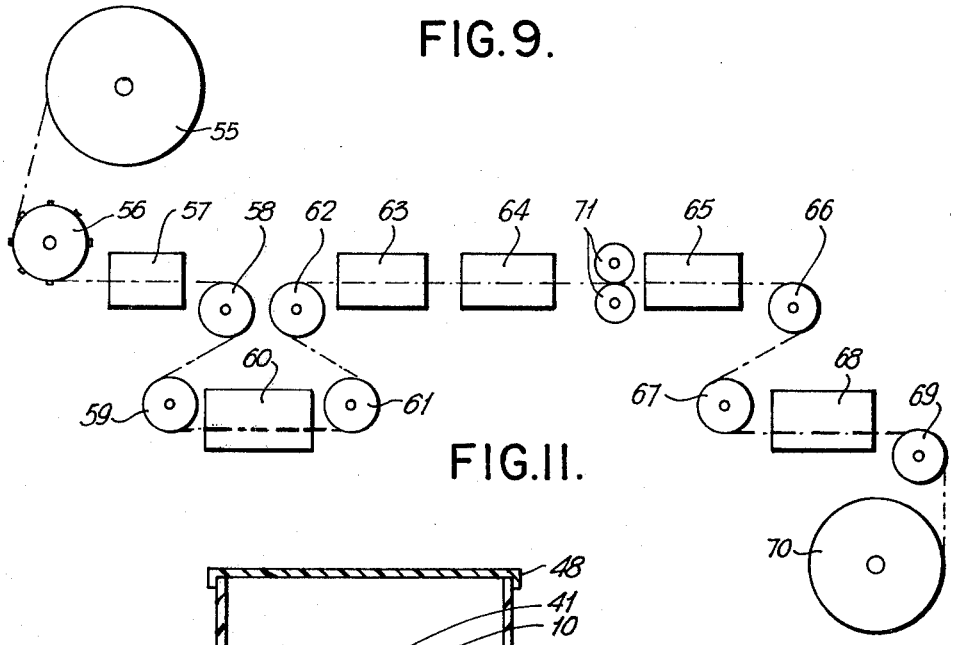
FIG. 11 is a diagrammatic illustration of one form of process line for plating terminal pins.

FIG. 11 illustrates very diagrammatically, an example of a plating line or process. Conveniently it will be described as for gold plating terminal pins. The pins, mounted on bandoliers are fed from a roll 55 round a toothed roller 56 into a first plating tank 57, for example a nickel plating tank. Here the bottom portion of each pin is nickel plated. The bandolier and pins then pass round rollers 58 and 59 which move the bandolier laterally and feed it to a mask applying station 60. At station 60, mask members, as in FIGS. 4 to 7, are stacked together, the members having a virtual orientation, and are fed one at a time beneath the bandolier and pins. A ram moves a masking member upwards, the lower parts of the pins entering the bores 26 in the member. After lowering of the ram a further masking member is fed forward, the bandoler and pins also being fed laterally a distance equal to the length of a masking member. The ram then lifts the next masking member. It will be appreciated that the bandolier and pins are fed through the plating line in steps, each movement corresponding to the length of a masking member. The particular form of apparatus for applying the masking members can vary considerably and it is possible to provide apparatus with a vertically acting ram which can also move laterally as it lifts, in which case the movement of the bandolier can be continuous.

From the masking member applying station 60 the bandolier and pins pass round rollers 61 and 62 and through first and second gold plating tanks 63 and 64, and a rinsing tank 65. From the rinsing tank 65 the bandolier and pins pass round rollers 66 and 67 to a masking member removing station 68. At station 68 the masking members are removed, for example by a fork-like member which enters between the pins above the masking member and pulls off the masking member by moving downwards. Alternatively gripping members may engage with the members and pull them off. The masking members are then returned to the applying station 60.

The bandolier and pins then pass round roller 69 and to a take-up roll 70. To provide for correct alignment of the bandolier and pins along the line, the various rollers 58, 59, 61, 62, 66, 67 and 69 can have projections on their periphery, similar to rolls 56, the projections engaging in the perforations 22 in the bandolier. Various ones of the rollers may be driven. Further rollers,, as indicated at 71, may be provided between tanks, and these rollers may also have projections thereon.

Normally a complete line will have more tanks than as illustrated in FIG. 11, in that precleaning and additional rinsing tanks may be desired. Also plating with copper and/or nickel or other metal may be carried out prior to gold plating. More than one plating of gold may be carried out. In the line as illustrated in FIG. 11, electrical contact can be made with the bandolier, and the pins, by means of making any of the rolls with an electrically conductive material and connecting a conductor thereto, as at 72. Electrical contact with an anode in each tank will also be provided.

The various solutions of the tanks will be monitored and the solutions maintained at the correct formulation by periodically adding constituents thereto. The plating of the items is normally by the conventional high plating speed techniques, wherein the plating is by deposition from a solution. While a gold anode can be used, other anodes can also be used and are non sacrificial or insoluable. The apparatus for applying the masks to the pins, and removing the masks from the pins after plating is adapted from conventional apparatus readily available.

While described particularly for the precious metal plating of preselected areas, the masking members can be used to define areas exposed to other surface treatment solutions.

What is claimed is:

1. A masking member for masking at least an end portion of elongate pins, said masking member being of a flat, platelike form having top and bottom edges and including a plurality of parallel bores extending from said top edge towards said bottom edge, each bore of a size to be a close sliding fit on a pin; the masking member having a vertical cross-section with a thickened portion at top and bottom connected by a thinner central, waisted, portion, the waisted portion at least on one side extending inward to coincide with said bores, a plurality of apertures being formed in said waisted portion, an aperture connecting with each bore.

2. A masking member as claimed in claim 1, said bores being of rectangular cross-section.

3. A masking member as claimed in claim 2, said bores being of square cross-section.

4. A masking member as claimed in claim 2, the thickness of the waisted portion at least no greater than the transverse dimension of the bores in a direction normal to the length of the member, a plurality of apertures being formed on each side of said waisted portion, an aperture on each side connecting with each bore.

5. A masking member as claimed in claim 1, said bores having longitudinal axes spaced apart a predetermined distance from each other, the distance between the longitudinal axis of an end bore and an adjacent end surface of the masking member no greater than half said predetermined distance.

6. A method of plating preselected localised areas of an end portion of alongate pins, comprising:

spacing the pins on a bandolier strip, the longitudinal axis of the pins being parallel;

applying a masking member to the ends of a plurality of pins, the masking member in the form of a flat platelike member having top and bottom edges and a plurality of bores extending from said top edge, each bore being a close sliding fit on a pin, the masking member including a central, waisted, portion of reduced thickness no greater than the transverse dimension of a pin whereby an aperture connecting with each bore is defined;

feeding said bandolier and said pins through at least one plating tank, and applying a plating solution to said masking members, the plating solution contacting said pins through said apertures.

* * * * *